United States Patent [19]

Mandl et al.

[11] 4,413,378

[45] Nov. 8, 1983

[54] METHOD AND DRAFTING ARRANGEMENT FOR SPINNING MACHINES FOR PROCESSING A FIBER SLIVER

[75] Inventors: Gerhard Mandl, Bruetten; Giancarlo Mondini; Viktor Pietrini, both of Winterthur; Kurt Weber, Elgg; Rudolf Wildbolz, Winterthur, all of Switzerland

[73] Assignee: Rieter Machine Works Limited, Winterthur, Switzerland

[21] Appl. No.: 362,873

[22] Filed: Mar. 29, 1982

[30] Foreign Application Priority Data

Apr. 6, 1981 [CH] Switzerland ..... 2309/81

[51] Int. Cl.[3] ..... D01H 5/70; D01H 5/74

[52] U.S. Cl. ..... 19/258; 19/266; 19/273; 19/284

[58] Field of Search ..... 19/258, 266–285

[56] References Cited

U.S. PATENT DOCUMENTS

| | | | |
|---|---|---|---|
| 1,942,329 | 1/1934 | Gegauff | 19/281 X |
| 2,343,259 | 3/1944 | Jones et al. | 19/277 X |
| 2,359,820 | 10/1944 | Solanas | 19/276 |
| 3,058,170 | 10/1962 | Cotchett | 19/281 X |
| 3,060,669 | 10/1962 | Kingsbury | 19/271 X |
| 3,126,587 | 3/1964 | Rulon-Miller et al. | 19/273 X |
| 3,748,694 | 7/1973 | Staneff | 19/258 |
| 3,778,995 | 12/1973 | Sanders | 19/258 X |

*Primary Examiner*—Louis Rimrodt

*Attorney, Agent, or Firm*—Werner W. Kleeman

[57] ABSTRACT

The present invention concerns a method for processing a fiber sliver in a drafting arrangement, and a drafting arrangement for implementing the method. The objective for a drafting arrangement, which can be adapted to a wide range of staple lengths, to draft a fiber sliver at high speeds, has led to the following features of the invention:

(a) The fiber sliver is deflected simultaneously in the drafting process systematically in such a manner that, the fiber sliver can be inserted into the subsequently arranged funnel and the subsequently arranged pair of calender rolls without further deflection.

(b) All bottom rolls are fixedly arranged.

(c) The first pressure rolls limiting the pre-drafting zone and the main drafting zone, respectively, are arranged to be shiftable along an arc about the rotational axis of the corresponding bottom roll in such a manner that the drafting zones are adaptable to the fiber length.

In order to position these pressure rolls accurately in parallelism with respect to the corresponding bottom roll on the arc, there are provided arresting devices co-axially arranged with respect to the arc for taking-up bearing block pairs supporting the pressure rolls.

(d) All pressure rolls as well as the pressure roll mounted on a double arm are jointly pivotable from a lifted-off threading-in position to a working position and vice versa.

22 Claims, 6 Drawing Figures

A-A 45.1
48
34
45
47
46
32;49
44
51
52
42
39
41
43
40
35
36
37
38

METHOD AND DRAFTING ARRANGEMENT FOR SPINNING MACHINES FOR PROCESSING A FIBER SLIVER

BACKGROUND OF THE INVENTION

The present invention relates to a new and improved method of, and a drafting, arrangement for, spinning machines, particularly for draw frames, for processing a fiber sliver with a staple range encompassing short to long staple fibers.

The drafting arrangement comprises a pre-draft zone and a main draft zone, as well as bottom rolls arranged on a machine frame and pressure rolls arranged thereabove and forming drafting zones.

In German Pat. No. 1,250,315 a drafting arrangement is shown and described, which, as seen in the direction of movement of the fiber sliver, contains an input pair of rolls, an intermediate pair of rolls, and a pair of delivery rolls. Each roll pair consists of a bottom roll and a corresponding or related pressure cell.

The pair of input rolls and the pair of intermediate rolls collectively form a pre-draft zone, whereas the pair of intermediate rolls and the pair of delivery rolls form a main draft zone.

The pair of input rolls is linearly shiftable forwards and backwards, as seen in the direction of movement of the fiber sliver, for the purpose of adapting the length of the pre-draft zone. Both rolls are independently shiftable.

The intermediate and the delivery bottom rolls are fixedly arranged, whereas the intermediate and the delivery pressure rolls are linearly shiftable in the same manner as the input pressure roll.

All three pressure rolls are vertically movable with respect to a base plate taking-up the bearing blocks of the bottom rolls, in such a manner that during the aforementioned linear shifting of the pressure rolls, the latter can effect, in combination with the vertical movability, a movement about the fixed or fixedly arranged bottom rolls. Thus, the possibility is given to adapt the length of the main drafting zone and to adapt it to the staple length to a certain extent.

The diameter of the delivery bottom roll is larger than the diameter of all of the other rolls. The bearing blocks of the pressure rolls are arranged to be linearly shiftable on the bearing blocks of the bottom rolls. The pressure applied to the pressure rolls is exerted by using spring-loaded pressure pistons which are mounted upon a pivotable and arrestable support member.

Furthermore, in Swiss Pat. No. 426,570 there is disclosed a drafting arrangement containing a pre-draft zone and a main draft zone, in which the pressure rolls are arranged to be pivotable about the axis of the bottom rolls for enlarging or shortening the wrapping arc of the fiber sliver upon the bottom rolls.

For adapting the nip line distances, limiting the pre-draft zone and the main draft zone, to the staple length of the fiber material to be processed, the mutual distances of the groups of rolls are changeable.

Production increases in a drafting arrangement necessarily imply an increase in sliver speed. High sliver speeds, for instance, of 800 m/min. or more, of the drafted sliver, i.e. at the delivery side of the drafting arrangement, require high rotational speeds of the drafting arrangement rolls which, in turn, imposes more stringent requirements upon the bearings of the rolls.

The useful service life of a bearing is determined, apart from the factors of rotational speed and bearing load, by the accuracy of the settings or mounting, for instance with respect to the parallelity of the pressure rolls and the related bottom rolls, and with respect to the accurate alignment of the roll axes with respect to the elements driving the shafts.

If the drafting arrangement disclosed in German Pat. No. 1,250,315 is considered under the abovementioned aspects, it will be recognised that for the shiftability and the arrestability, respectively, of the bearing blocks for the pair of input rolls, and the bearing blocks for the intermediate and the delivery pressure rolls, there are not provided any special devices or facilities for accurately arresting or fixation thereof. Hence, these bearing positions are only adjustable or settable in a relatively inaccurate manner, or only by using special setting or adjustment devices, which have been neither shown nor described. The use of such auxiliary devices, however, is time-consuming, cumbersome, and thus, unsatisfactory.

Furthermore, the mutual linear shiftability of the pressure rolls with respect to the bottom rolls, for the purpose of adapting the nip line distances of the drafting zones, exhibits the disadvantage that, due to the linear shifting of the pressure rolls the spring or resilient forces of the pressure pistons act with varying force upon the fiber sliver, depending upon the position of the pressure rolls at the bottom rolls, which influences the force components in angular direction.

A further disadvantage resides in the large diameter of the delivery bottom roll, which causes an increased nip line distance in the main drafting zone.

Furthermore, the drafting system exhibits the disadvantage that, for instance, for guiding the fiber sliver into a sliver can, there is required an additional deflection of the sliver after the drafting arrangement. At sliver speeds of 13.3 m/sec. and more such imposes an additional, undesirable stress upon the sliver, caused by centrifugal forces, and thus, constitutes a disadvantage of the method.

SUMMARY OF THE INVENTION

It thus is an important object of the present invention to eliminate these disadvantages.

A further significant object of the present invention is directed to a new and improved method and drafting arrangement for spinning machines for processing a fiber sliver in a manner not afflicted with the aforementioned drawbacks and shortcomings of the prior art proposals.

Still a further important object of the present invention is directed to a new and improved drafting arrangement for spinning machines for processing a fiber sliver in a highly reliable and protective manner, allowing for improved sliver processing, while affording an apparatus construction which is relatively simple in design, economical to manufacture, extremely reliable in operation, not readily subject to breakdown or malfunction, and requires a minimum of maintenance and servicing.

Yet a further important object of the present invention aims at providing a new and improved method of, and drafting arrangement for, spinning machines for processing a fiber sliver wherein there can be reliably and effectively processed a wide range of staple lengths of the fibers.

Now in order to implement these and still further objects of the invention, which will become more readily apparent as the description proceeds, the method aspects of the present development are manifested by the features that, that with increasing speed of the fiber sliver, owing to the thinning of the fiber sliver during the drafting process, the direction of movement is deflected positively per drafting step in front of and/or within the drafting zone in such a manner that, the delivered fiber sliver is subjected, with respect to the inputted sliver, gradually to a total positive deflection of substantially a 90° angle, and that per positive deflection the angular acceleration (r.w.$^2$) does not exceed a value of 400/sec.$^2$.

Concerning the drafting arrangement of the present development, such is manifested by the features that, all bottom rolls are fixedly arranged on the machine frame. The first pressure roll, as seen in the direction of movement of the fiber sliver, limiting the pre-draft zone, as well as the first pressure roll, limiting the main drafting zone, are displaceably arranged and arrestably along a respective arc about the rotational axis of the corresponding or related bottom roll. The first bottom rolls limiting the drafting zones are of a diameter which corresponds at least to the longest fiber length to be processed.

The advantages achieved when practising the present invention reside substantially in that:

(a) Owing to the deflection of the fiber sliver in the drafting process, notwithstanding high sliver speeds at the delivery or output side of the drafting arrangement, the values of angular acceleration at the deflections or deflection locations in the drafting arrangement are maintained within acceptable limits.

(b) Owing to the deflection in the drafting process the fiber sliver, entering substantially horizontally, upon leaving the drafting arrangement, can be delivered without any additional deflection and over a short distance into the trumpet or funnel or into the subsequently arranged pair of calender rolls delivering a measuring value, so that an optimally short length of defective sliver can be transferred between the last pair of drafting rolls and the calender rolls.

(c) Owing to the fixed arrangement of the bottom rolls accurate alignment of the bearings is ensured after assembly, which positively contributes to the useful service life of the bearings and a reduction in the time required for accommodation of settings to other fiber staple lengths.

(d) Owing to the shiftability of the pressure rolls about the mentioned arc, there is possible an accommodation of the drafting arrangement to the staple length of the fiber sliver to be processed without changing the position of the bottom rolls.

(e) As the direction of the force exerted by the pressure rolls relative to the axis of the corresponding bottom roll remains the same, the effect of the force upon the fiber sliver remains constant.

An advantageous embodiment of the drafting arrangement is constituted by an arrangement of the pressure rolls upon a pivotable arm. By using this construction also broad fiber slivers can be easily and reliably inserted into the drafting arrangement.

A further advantageous embodiment resides in the features that, the shiftable or displaceable pressure rolls are adjustable and arrestable, by using an arresting device, for adaption to the encountered staple length, and the amount of shifting is measurable using a scale in such a manner that, notwithstanding the shiftability of the pressure rolls, there is ensured for accurate parallel guiding of the pressure rolls.

Furthermore, the shiftability or displaceability of the second pressure roll, limiting the main drafting zone, along an arc about the related bottom cylinder renders it possible to ensure for a tangential intake or infeed of the fiber into this pair of rolls, independently of whether there is used a pressure rod or bar causes a positive or a negative deflection of the fiber sliver.

Owing to the small diameter of the second bottom roll limiting the main draft zone the advantage results that, in spite of the also advantageous large diameter of the preceding bottom roll an optimally short nip distance is obtainable.

BRIEF DISCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, the exemplary construction of drafting arrangement 1 comprises a machine frame 2, at which there are pivotably supported, by using a hinge or link pin 3, the arm parts or elements 4 forming a double arm.

Figure 1:
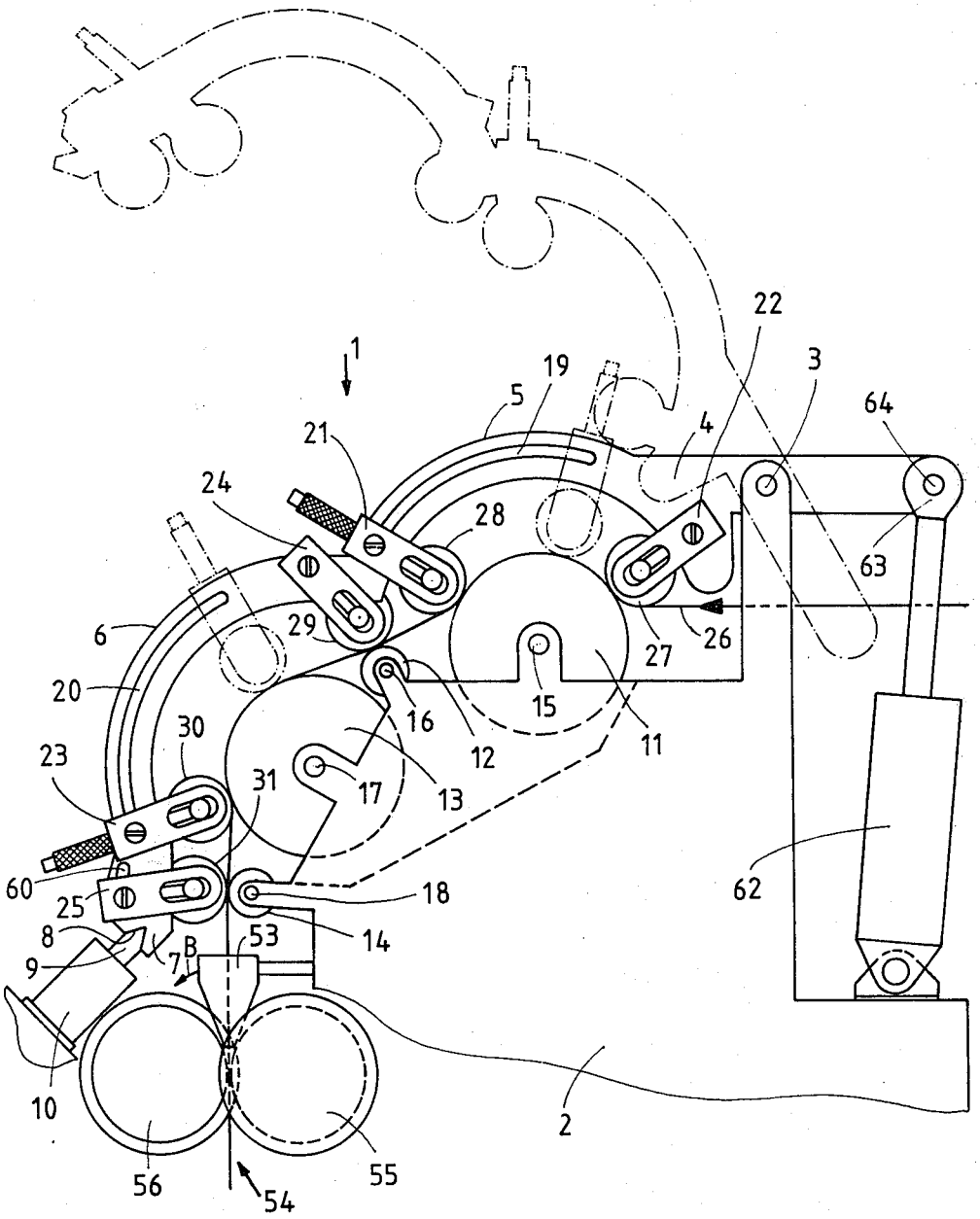
FIG. 1 is a side view of the invention drafting arrangement in its operating position and shown semi-schematically.
Figure 2:
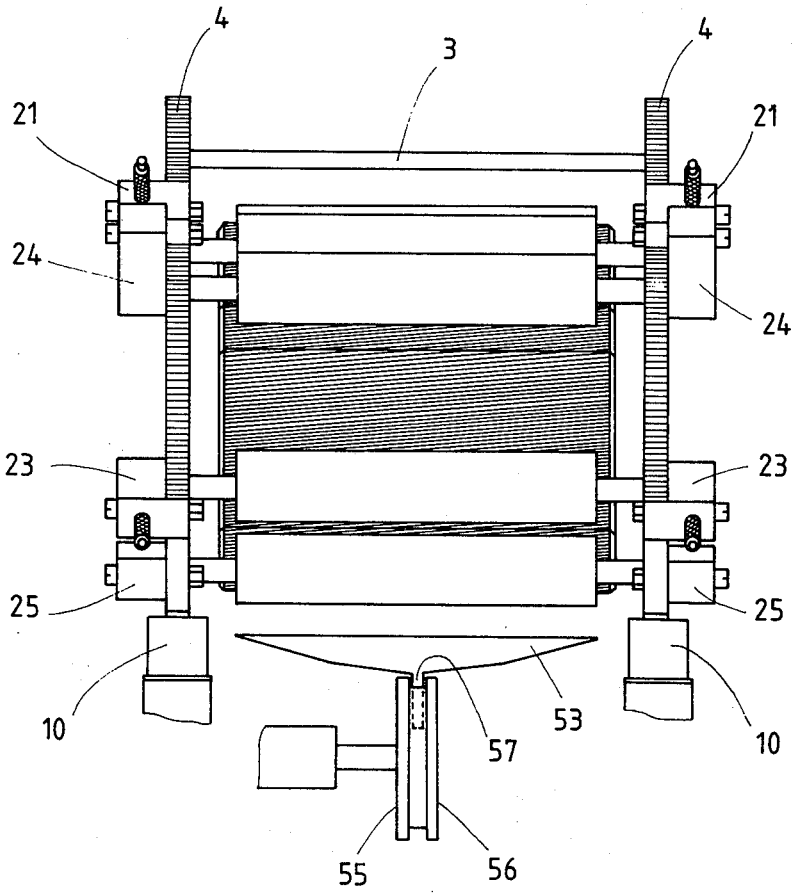
FIG. 2 is a front view of the drafting arrangement according to FIG. 1 in its operating position and shown semi-schematically.

The arm parts or elements 4 each comprise an arc or curved member 5 and an arc or curved member 6 as well as an end member 7. Provided on the end or terminal member 7 is a notch 8 for receiving a respective fixing pin or bolt 9. The fixing or arresting pin 9 is part of a pneumatic cylinder unit 10. The fixing pin or bolt 9 is designed to seatingly fit into the notch 8 and is used for fixing the double arm in the working position shown with solid lines in FIGS. 1 and 2. The lifted-off position of the double arm is indicated in FIG. 1 with dash-dotted or phantom lines.

The bottom rolls 11, 12, 13 and 14 are rotatably supported at the machine frame 2 by using the shafts or axles 15, 16, 17 and 18, respectively. The bottom rolls 11, 12, 13 and 14 are individually driven by using any suitable and therefore not particularly illustrated drive means.

The arc or curved parts 5 each comprising an arc-shaped guide slot or track 19 which is coaxially arranged with respect to the shaft or axle 15, and the arc or curved parts 6 each comprise an arc-shaped guide slot or track 20 which is coaxially arranged with respect to the shaft or axle 17. The guide slots or tracks 19 are used for guiding a pair of bearing blocks 21 (one part of the pair only being shown in FIG. 2), whereas the guide slots or tracks 20 are used for guiding a pair of bearing blocks 23. In the terminal or end portion 7 a guide slot 60 is arranged coaxially with respect to the shaft or axle 18 and is used for guiding a pair of bearing blocks 25.

A pair of bearing blocks 22 is fixedly arranged on the double arm 4 at the entrance or inlet side of the drafting arrangement, and a pair of bearing blocks 24 is arranged at the transition zone between the arc or curved part 5 and the arc or curved part 6.

Viewed in the direction of travel of the fiber sliver 26 (schematically indicated by an arrow in FIG. 1), the drafting arrangement 1 comprises, in the following sequence, a pressure roll 27 rotatably supported in the pair of bearing blocks 22, a first pressure roll 28 limiting the beginning of the pre-drafting zone and rotatably supported in the pair of bearing blocks 21, a second pressure roll 29 limiting the end of the pre-drafting zone and rotatably supported in the pair of bearing blocks 24, a first pressure roll 30 limiting the beginning of the main drafting zone and rotatably supported in the pair of bearing blocks 23, as well as a second pressure roll 31 limiting the end of the main drafting zone and rotatably supported in the pair of bearing blocks 25.

The rolls 11 and 28 form, as seen in the direction of movement of the fiber sliver 26, the first fiber sliver nip line, and the rolls 12 and 29 form the second nip line. These nip lines or nips limit the pre-drafting zone.

The rolls 13 and 30 form the first fiber sliver nip line, and the rolls 14 and 31 the second fiber sliver nip line. These nip lines limit the main drafting zone.

The pairs of bearing blocks 22 and 24 are fixedly arranged, whereas the pairs of bearing blocks 21 and 23, respectively, are slideably arranged along the guide slots 19 and 20, respectively, for adaption or accommodation to the staple length of the fiber sliver to be processed, and after adaptation thereto are again fixable or arrestable. Furthermore, the pair of bearing blocks 25 is slideably and again arrestably or fixably arranged in the guide slot 60, in order to ensure for the tangential intake or infeed of the fiber sliver, notwithstanding the variable intake position of the fiber sliver, which can change due to the shifting of the pressure roll 30.

Figure 3:
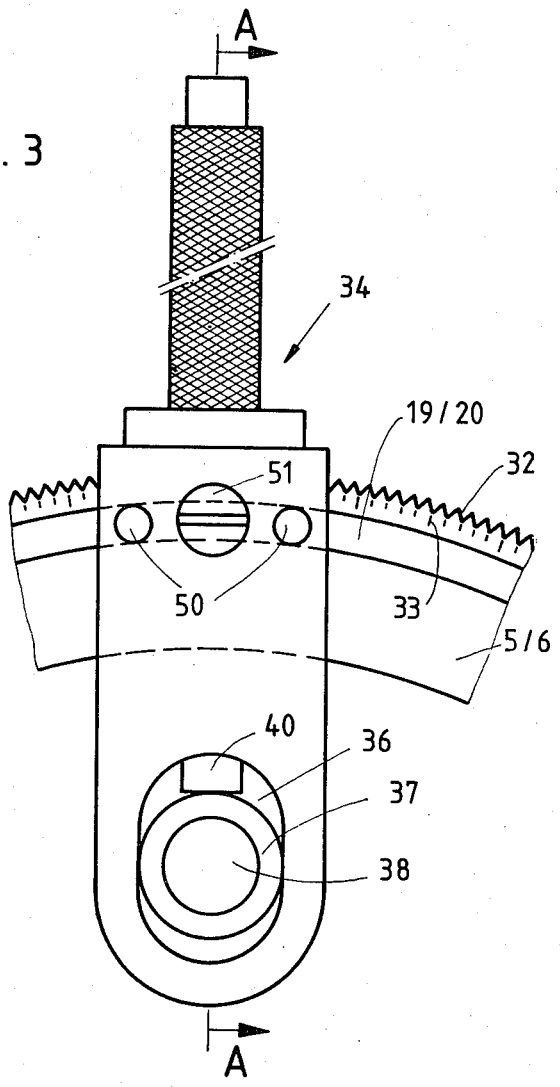
FIG. 3 illustrates a detail of the drafting arrangement according to FIG. 1 as seen from the same side and shown semi-schematically.

For ensuring for substantial parallelism of the pressure rolls 28 and 30 with respect to the bottom rolls 11 and 13, respectively, in radial direction with respect to the axes or shafts 15 and 17, respectively, there are provided, on the one hand, on the arc or curved parts 5 and 6 the latching or ratcheting teeth 32 (FIGS. 3 and 4) and a scale 33 corresponding to the number of such latching or ratcheting teeth 32, and, on the other hand, on the pairs of bearing blocks 21 and 23 there is provided a respective arresting device 34 which engages with the latching teeth 32. This arresting device 34 is co-ordinated to each individual bearing block of the pairs of bearing blocks 21 and 23. A bearing block of such type comprises a lower block part 35 equipped with a guide opening 36 for taking-up and for guiding a shaft bearing 37 of a pressure roll shaft 38. Each respective pressure roll shaft 38 is used for mounting of the related pressure rolls 27, 28, 29, 30 and 31.

Furthermore, the lower bearing block part 35 is shaped as a cylinder containing a piston 39, a related piston rod 40, a spring 41, a compressed air connection 42, and an exhaust opening or port 43.

A bearing block upper part 44, which is rigidly connected to the bearing block lower part 35, is used as a closing cover of the cylinder arrangement.

In the bearing block upper part 44 there is rigidly threadibly secured a guide pin 45, which is part of the arresting device 34, the guide pin 45 being threaded into the upper part 44 by means of the threaded portion 46. The guide pin 45 guides an arresting member 47. A pressure spring 48, tensioned between the arresting member 47 and a guide pin upper portion 45.1, presses the arresting member 47 against the bearing block upper part 44. The arresting member 47 can be lifted-off from the bearing block upper part 44 against the force of the pressure spring 48.

Figure 4:
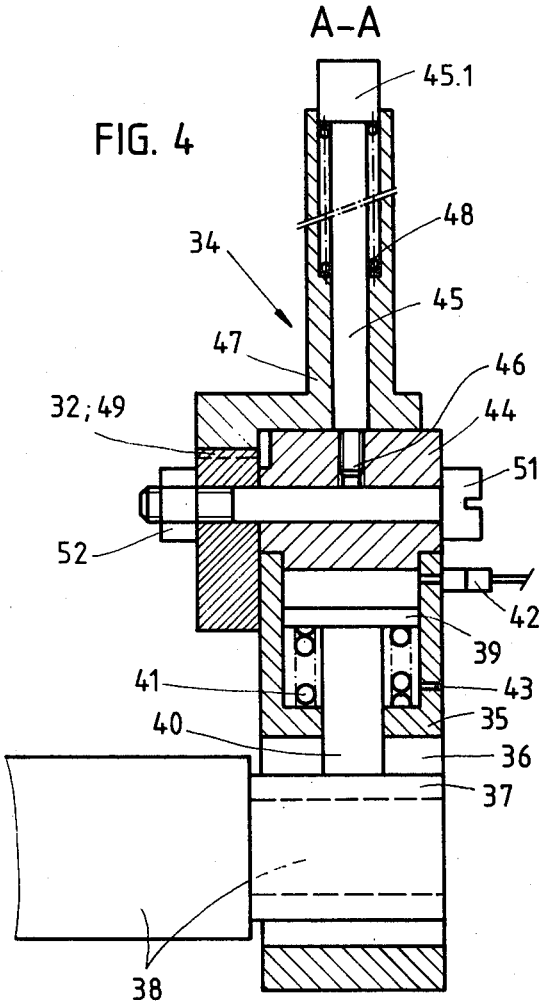
FIG. 4 illustrates a detail of FIG. 3, partially shown in sectional view along the line A—A and shown semi-schematically.

The latching or ratcheting teeth 32 provided on the arc or curved parts 5 and 6 engage, as the arresting member 47 contacts the bearing block upper part 44, with the teeth 49 provided on the arresting member 47, as best seen by referring to FIG. 4.

Furthermore, two guide pins 50 are pressed into the bearing block upper part 44. These guide pins 50 penetrate into the guide slots 19 or 20, as the case may be, and the diameter of such guide pins is chosen such that there results an accurate sliding guidance of the individual bearing blocks 21, 23, 25 along the related guide slots 19, 20 and 60, respectively.

A fixing bolt or screw 51 or equivalent structure provided with a nut 52 arrests the individual bearing blocks at the arc or curved parts or elements 5 and 6 and at the end part 7, respectively.

If the pairs of bearing blocks 21 and/or 23 are to be shifted, then the related fixing screw 51 (FIGS. 3 and 4) is loosened, the arresting member 47 is raised, while applying a manual force against the action of the force of the spring 48, from the bearing block lower part 44 along the guide pin 45. Now the pair of bearing blocks 21 and/or 23 are slid in contact with and along the related guide slot 19 and 20, respectively, upon the curved part or element 5 and 6 respectively. The amount of shifting can be read at the arresting device scale 33 or equivalent structure.

The pairs of bearing blocks 22, 24 and 25 comprise the same elements as the pairs of bearing blocks 21 and 23 heretofore described, with the exception that the arresting device 34 is dispensed with.

The pairs of bearing blocks 22 and 24 are fixedly arranged. The movability of the pairs of bearing blocks 25 will be again described later on.

Furthermore, the fiber sliver 26 is collected or condensed after the last fiber sliver nip line or nip, formed by the rolls 14 and 31, in a funnel or trumpet 53 and is transferred to a rotatably supported pair of calender rolls 54 known as such in this art. The pair of calender rolls 54 consists of a fixedly arranged calender roll 55 and a calender roll 56 which is mounted to be shiftable away therefrom.

The funnel 53 or the like is arranged to be tiltable or pivotable in the direction of the arrow B and protrudes by means of its fiber sliver delivery part 57 into the fiber sliver intake or infeed gap or nip of the pair of calender rolls 54.

When the calender roll 56 is shifted away, then the funnel 53 can be tilted for easier insertion of the fiber sliver 26, delivered from the last pair of coacting rolls 14 and 31, into the funnel 53.

Figure 5:
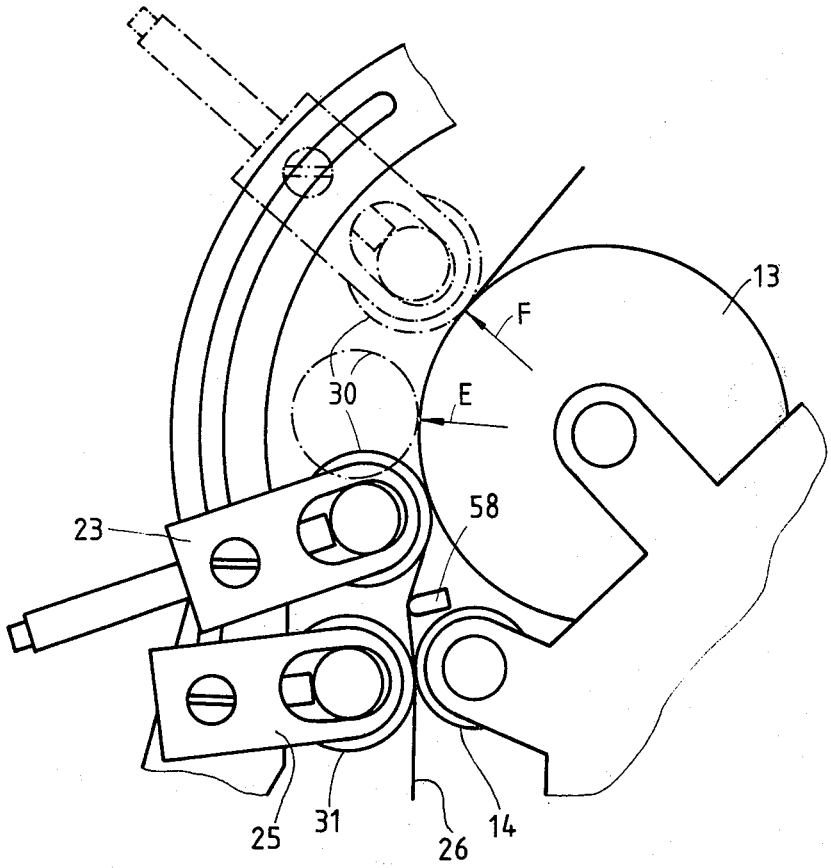
FIGS. 5 and 6 respectively show alternative embodiments of the drafting arrangement according to FIG. 1, each depicted as an enlarged partial view of FIG. 1.

The drafting arrangement 1 additionally can be equipped with a so-called pressure rod or bar 58 (FIG. 5) which is provided in the main drafting zone. This pressure bar 58 positively deflects the fiber sliver, and thus, provides auxiliary guidance of the fiber in the drafting zone. In the context of this disclosure the term positive deflection is to be understood as designating a deflection with a radius extending away from the machine frame 2. The pressure rod or bar 58 in this arrangement is provided in the main drafting zone in such a manner that, as the nip line distance of the main drafting zone, determined by the nip lines of the pairs of rolls consisting of the rolls 13 and 30, and 14 and 31, respectively, is lengthened by rearwardly shifting the pressure roll 30 toward the position indicated with dash-dotted or phantom lines in FIG. 1, the deflection about the pressure bar 58 is reduced. The reduction of the deflection then terminates if a position is reached, in which the distance connecting the pressure rod or bar 58 and the nip line between the rolls 13 and 30 forms a tangent at the circumference of the rolls 13 and 30. This first nip line distance is indicated in FIG. 5 by the arrow E, whereas the maximum nip line distance of, for instance, 85 mm. is reached at the position designated with the arrow F.

If there is used the pressure bar or rod 58, then the pair of bearing blocks 25 is positioned or fixed, respectively, such that the fiber sliver 27 is taken-in tangentially by the rolls 14 and 31.

Figure 6:
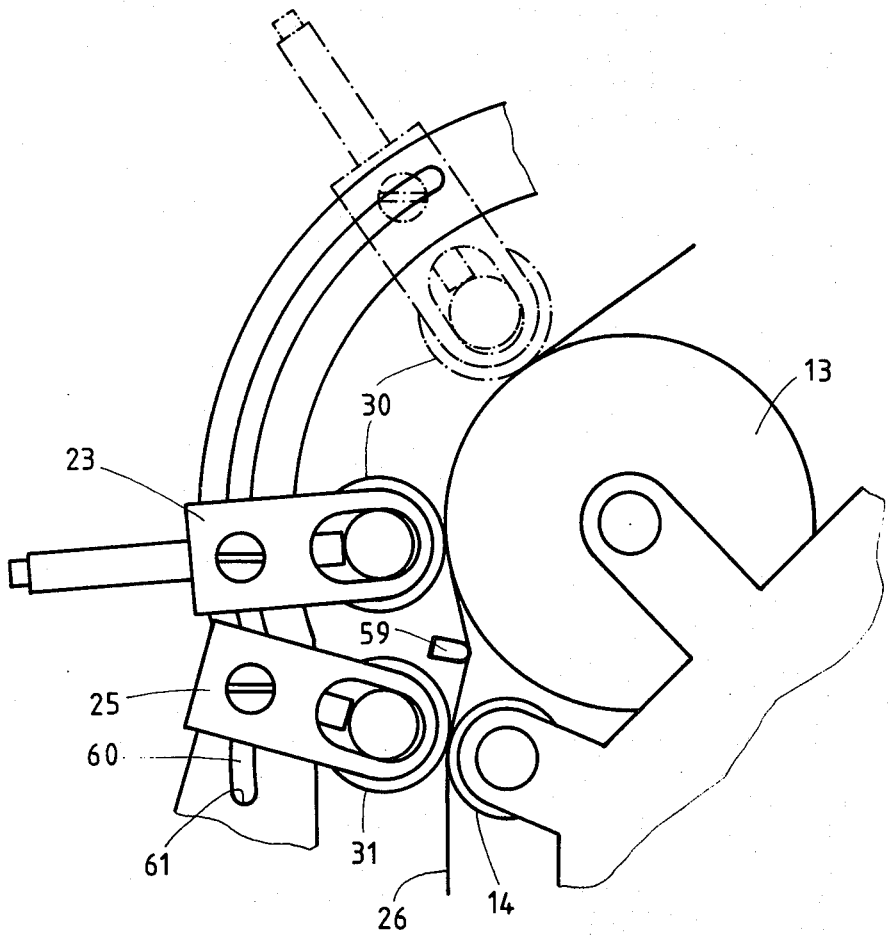

Furthermore, the drafting arrangement 1, as an alternative to the pressure bar 58, can be equipped with a pressure rod or bar 59 (FIG. 6), which negatively deflects the fiber sliver. When using this solution, the deflection effected by the pressure bar 59 remains constant. In order to ensure for the tangential intake of the fiber sliver by the rolls 14 and 31, also in this alternative arrangement, the pair of bearing blocks 25 is shifted into the position shown in FIG. 6. In this position the upper guide pins 50 (as seen in the viewing direction according to FIG. 1) of the pair of bearing blocks 25 rest against the upper end (not visible) of the guide slot 60 provided in both end or terminal portions 7, whereas in the arrangement using the pressure rod or bar 58, the lower guide pins 50 of the pair of bearing blocks 25 rest against the lower end 61 (FIG. 5) of the guide slots 60.

In this manner the same drafting arrangement is suitable, without having to change any parts, for the utilization of either of the two pressure bar variants.

For lifting the arm elements or parts 4, into the position indicated in FIG. 1 with dash-dotted or phantom lines, constituting the lifted-off threading-in or servicing position, and thus, serving for inserting a fiber sliver into the drafting arrangement, there is used a pneumatic cylinder 62 which is pivotably connected to the machine frame 2. The piston rod end portion 63 of the pneumatic cylinder unit 62 is connected with the two arm parts or elements 4 by means of a rod 64.

For insertion into the drafting arrangement in its lifted-off or open position, the fiber sliver 26 is placed over the bottom rolls and the funnel 53 pivoted in the direction of the arrow B.

By reversing the operation of the cylinder unit 62 the drafting arrangement is again closed, and again locked by reversing the operation of the cylinders 10.

Upon starting the machine at creep speed, the drafted material is inserted into the funnel or trumpet 53 and then into the pair of calender rolls 54. Thereafter, the drafting arrangement can be switched to its normal production speed.

Under the term "short to long staple fibers" there also are to be understood cotton and man-made fibers of a staple length of up to 80 mm.

For those bottom rolls which from the beginning of the pre-drafting zone and the main drafting zone, a diameter of 90 mm is chosen, so that also when processing fibers of 80 mm staple length there can be ensured a wrapping angle of the fiber sliver upon said bottom rolls of maximum 45 angle degrees, as practical experience has shown.

At wrapping angles exceeding an angle of 45° the friction due to the cord wrapping angle between the fiber sliver and the bottom roll becomes too great with conventional fluting of the bottom rolls.

The initially mentioned high sliver speeds cause high centrifugal forces, i.e. high values of angular or radial acceleration.

At a sliver speed of, for instance, 1000 m/min. at the delivery or outlet point of the drafting arrangement, and with a diameter of 90 mm. of the first bottom roll 13 of the main drafting zone and at a draft ratio of 4:1, the angular or radial acceleration reaches a value $a_r = -r \cdot w^2 = 385$ m/sec$^2$, which corresponds to 38 times the (earth) gravitational acceleration.

If, when using a drafting arrangement according to the above-mentioned state of the art, the fiber sliver delivered at 1000 m/min. were to be deflected at an angular acceleration value of $a_r = 385$ m/sec$^2$, a deflection radius of 720 mm would have to be chosen, which from the standpoint of design considerations would prove unfavorable.

For obtaining, in spite of the favorable large diameter of the first bottom roll 13 of the main drafting zone, an optimally short nip line distance, for drafting fiber material with short staple lengths, the diameter of the second bottom roll 14 of the main drafting zone was chosen to correspond to substantially one-third of the diameter of the first-mentioned bottom roll 13, for instance amounted to 28 mm.

Due to the selection of a small diameter for this roll 14, high rotational speeds are required for the high sliver speeds which on the other hand, result in high values of the angular acceleration. However, since the deflection of the fiber sliver on this roll is zero or does not exceed an angle of a few angle degrees, and since thus no or a very small fiber sliver mass must be deflected, no or relatively small centrifugal forces ($Z = m \cdot r \cdot w^2$) are generated in the fiber sliver which is closed within itself. The case is different for loose individual fibers, diverted by the roll 14 from the fiber sliver which, as such, is closed within itself. Such fibers are deflected, until a centrifugal force results from the deflected mass, which exceeds the adhesion forces between the fiber and the roll.

In order to counteract possible electrostatic charges built up in the fiber material, there can be used in known manner conventional ionizing devices.

While there are shown and described present preferred embodiments of the invention, it is to be distinctly understood that the invention is not limited thereto, but may be otherwise variously embodied and practiced within the scope of the following claims.

What we claim is:

1. In a method of processing a staple fiber sliver with a staple range between short to long staple fibers in a drafting arrangement for spinning machines, particularly for draw frames, wherein the staple fiber sliver is subjected to a high draft in drafting steps within drafting zones, the improvement which comprises:

positively deflecting the direction of movement of the fiber sliver per drafting step in front of and/or within the drafting zone, as the speed of the fiber sliver increases owing to thinning of the fiber sliver during the drafting process, in a manner such that the delivered fiber sliver, in relation to the inputted fiber sliver, is gradually subjected to a total positive deflection of substantially a 90° angle and that per positive deflection the angular acceleration ($r.\omega^2$) does not exceed a value of 400 m/sec$^2$.

2. The method as defined in claim 1, further including the steps of:

additionally deflecting the fiber sliver in a main drafting zone and thereby additionally guiding the fiber sliver.

3. The method as defined in claim 2, wherein:

the step of additionally deflecting the fiber sliver is accomplished by using a pressure bar which serves to additionally guide said fiber sliver.

4. The method as defined in claim 2, further including the steps of:

during individual deflection of the fiber sliver ensuring that the degree of deflection of the longest fibers contained therein does not exceed an angle of 45°.

5. The method as defined in claim 1, further including the steps of:

employing for the drafting process a pre-drafting zone and a main drafting zone.

6. The method as defined in claim 1, further including the steps of:

compressing the fiber sliver prior to subjecting such to the drafting process.

7. A drafting arrangement for spinning machines, particularly for draw frames, for processing a staple fiber sliver with a staple range of cotton fibers and man-made fibers comprising:

a machine frame;

a plurality of bottom rolls each having a rotational axis;

a plurality of pressure rolls arranged above and in cooperating relationship with said bottom rolls;

said bottom rolls and pressure rolls delimiting a pre-draft zone and a main draft zone;

means for fixedly mounting all of said bottom rolls on said machine frame;

one of said pressure rolls, viewed in the direction of travel of the fiber sliver, limiting the pre-draft zone and defining a first pressure roll for the pre-draft zone;

a further one of said pressure rolls, viewed in the direction of travel of the fiber sliver, limiting the main drafting zone and defining a first pressure roll for the main draft zone;

means for movably mounting and fixably positioning each of said respective first pressure rolls which respectively delimit the pre-draft zone and the main draft zone for movement along a substantially arcuate-shaped path of travel about the rotational axis of their related bottom roll; and said bottom rolls including respective first bottom rolls limiting the pre-draft zone and the main draft zone and each of said respective first bottom rolls possessing a diameter which at least corresponds to the length of the longest fibers which are to be processed.

8. The drafting arrangement as defined in claim 7, wherein:

said bottom rolls pressure a diameter and an arrangement selected such that the fiber sliver, during the drafting process, is guided along a substantially quarter-circle shaped path through the drafting arrangement.

9. The drafting arrangement as defined in claim 7, wherein:

said drafting arrangement comprises four bottom rolls and at least four pressure rolls for limiting the pre-draft zone and the main draft zone; and said first bottom roll limiting the pre-draft zone, viewed in the direction of travel of the fiber sliver, and said first bottom roll limiting the main drafting zone, each possessing a diameter of about 90 millimeters.

10. The drafting arrangement as defined in claim 7, wherein:

said mounting means for said first pressure rolls comprises a double arm structure pivotably mounted at the machine frame and at which there are mounted each of the pressure rolls.

11. The drafting arrangement as defined in claim 10, wherein:

said pressure rolls include a second pressure roll delimiting the main draft zone;

said mounting means for the pressure rolls including structure for mounting said second pressure roll so as to be shiftable and arrestably arranged along an arcuate-shaped path of travel about the axis of rotation of its related bottom roll; and said arcuate-shaped path of travel being defined by a guide slot provided at said double arm structure.

12. The drafting arrangement as defined in claim 10, wherein:

said arcuate-shaped paths of travel are defined by guide slots provided at the double arm structure.

13. The drafting arrangement as defined in claim 12, wherein:

at least the first pressure rolls limiting an input end of the pre-draft zone and the main draft zone are each shiftable on the double arm structure by means of bearing bodies taking-up shafts of the first pressure rolls and which are guided in the guide slots.

14. The drafting arrangement as defined in claim 12, further including:

bearing bodies provided for said first pressure rolls;

said double arm structure being provided with latching teeth means arranged concentrically with respect to each related guide slot; and said latching teeth means serving for positioning the bearing bodies which take-up the first pressure rolls limiting the pre-shaft zone and the main draft zone, respectively.

15. The drafting arrangement as defined in claim 14, further including:

an arresting device engaging with the latching teeth means and provided for each of the bearing bodies.

16. The drafting arrangement as defined in claim 15, wherein:

each of said bearing bodies comprise a bearing block upper part;

said arresting device comprising a guide pin threadably connected with the bearing block upper part and an arresting member engaging with the latching teeth means and movably guided by means of said guide pin; and said arresting device further comprising spring means tensioned between the guide pin and the arresting member such that the arresting member engages with the latching teeth means owing to the force exerted by said spring means.

17. The drafting arrangement as defined in claim 10, further including:

an intake region for the fiber sliver;

a pressure roll contacting a related bottom roll provided at said intake region of the fiber sliver into the drafting arrangement; and a bearing body provided on the double arm structure for taking-up said pressure roll provided at said intake region.

18. The drafting arrangement as defined in claim 7, further including:

an intake region for the fiber sliver; and a pressure roll contacting a related bottom roll provided at said intake region of the fiber sliver into the drafting arrangement.

19. The drafting arrangement as defined in claim 7, further including:

a pressure bar provided at the main draft zone such that the fiber sliver is subjected to a deflection.

20. The drafting arrangement as defined in claim 19, wherein:

said pressure bar is arranged such that as a nip distance of the main draft zone is enlarged by setting back the first pressure roll limiting the main draft zone the deflection of the fiber sliver about the pressure bar decreases up to a first nip distance and then remains constant up to a maximum nip distance of about 85 millimeters.

21. The drafting arrangement as defined in claim 19, wherein:

said pressure bar is arranged in a manner such that as a nip distance of the main draft zone is enlarged by setting back the first pressure roll limiting the main draft roll the deflection of the fiber sliver about the pressure bar remains essentially constant.

22. The drafting arrangement as defined in claim 7, wherein:

the diameter of a second bottom roll limiting the main draft zone corresponds substantially to about one-third of the diameter of said first bottom roll of said main draft zone.

* * * * *

UNITED STATES PATENT AND TRADEMARK OFFICE

CERTIFICATE OF CORRECTION

PATENT NO. : 4,413,378

DATED : November 8, 1983

INVENTOR(S) : GERHARD MANDL et al

It is certified that error appears in the above–identified patent and that said Letters Patent are hereby corrected as shown below:

Column 9, claim 8, line 66, delete "pressure" and insert --possess

Column 10, claim 14, line 50, delete "pre-shaft" and insert --pre-draft--

Signed and Sealed this

*Seventeenth* Day of *January 1984*

[SEAL]

*Attest:*

GERALD J. MOSSINGHOFF

*Attesting Officer*

*Commissioner of Patents and Trademarks*